US006881281B2

(12) United States Patent
Kanmuri et al.

(10) Patent No.: US 6,881,281 B2
(45) Date of Patent: Apr. 19, 2005

(54) HIGH-STRENGTH, HIGH CONDUCTIVITY COPPER ALLOY EXCELLENT IN FATIGUE AND INTERMEDIATE TEMPERATURE PROPERTIES

(75) Inventors: Kazuki Kanmuri, Hitachi (JP); Kazuhiko Fukamachi, Hitachi (JP)

(73) Assignee: Nikko Metal Manufacturing Co., Ltd. (JP)

( * ) Notice: Subject to any disclaimer, the term of this patent is extended or adjusted under 35 U.S.C. 154(b) by 0 days.

(21) Appl. No.: 10/759,217

(22) Filed: Jan. 20, 2004

(65) Prior Publication Data

US 2004/0208778 A1 Oct. 21, 2004

(30) Foreign Application Priority Data

Jan. 23, 2003 (JP) ..... 2003-014810

(51) Int. Cl.[7] ..... C22C 9/00

(52) U.S. Cl. ..... 148/432; 148/433; 148/434; 148/435; 148/436; 420/484; 420/492

(58) Field of Search ..... 148/432–436; 420/484, 492

(56) References Cited

FOREIGN PATENT DOCUMENTS

| | | | |
|---|---|---|---|
| EP | 0492987 | * | 1/1992 |
| JP | 2001244398 | * | 9/2001 |
| JP | 2002003963 | * | 1/2002 |

* cited by examiner

*Primary Examiner*—Sikyin Ip
(74) *Attorney, Agent, or Firm*—Jeffrey I. Auerbach; Liniak, Berenato & White

(57) ABSTRACT

The present invention provides a Cu—Cr—Zr alloy material excellent in fatigue and intermediate temperature characteristics, which comprises 0.05 to 1.0% by mass of Cr and 0.05 to 0.25% by mass of Zr with a balance of Cu and inevitable impurities. The alloy comprises inclusion particles based on any one of Zr and a Cu—Zr alloy having a diameter of 0.1 $\mu$m or more, and the proportion of the inclusion particles containing 10% or more of sulfur as one of the inevitable impurities is one particle/mm$^2$.

4 Claims, No Drawings

HIGH-STRENGTH, HIGH CONDUCTIVITY COPPER ALLOY EXCELLENT IN FATIGUE AND INTERMEDIATE TEMPERATURE PROPERTIES

BACKGROUND OF THE INVENTION

1. Field of the Invention

The present invention relates to a high-strength high-conductivity copper alloy excellent in fatigue and intermediate temperature characteristics. Particularly, the present invention relates to conductive spring materials used for various terminals, connectors, relays and switches.

2. Description of the Related Art

The following characteristics are required of conductive spring materials used for various terminals, connectors, relays and switches:

(a) sufficient strength for generating high contact pressure even when in the form of thin sheets;

(b) a low stress relaxation ratio with the contact pressure not decreasing after a long-term use at high temperatures;

(c) a high conductivity with small Joule heating, which is generated by a flowing electric current, and radiation of the generated heat;

(d) prevention of crack and roughness formation at bent portions even when applying severe bend processing; and (e) a high elastic limit so as to enable the alloy to be used under high stress.

Phosphor bronze has been used as a conductive spring material for various terminals, connectors, relays and switches. However, since electronic appliances and components thereof have been required to be small in size and thin, demands for suitable materials have increased accordingly, and improvements in strength, conductivity, heat resistance and fatigue characteristics have been required. Various kinds of Cu—Cr alloys and Cu—Cr—Zr alloys have been developed to comply with these requirements.

Patent Reference 1: Japanese Unexamined Patent Application Publication No. 9-087814

Patent Reference 2: Japanese Unexamined Patent Application Publication No. 7-258804

Patent Reference 3: Japanese Unexamined Patent Application Publication No. 7-258806

Patent Reference 4: Japanese Unexamined Patent Application Publication No. 7-258807

Patent Reference 5: Japanese Unexamined Patent Application Publication No. 7-268573

Patent Reference 6: Japanese Patent No. 2682577

The drawability of Cu—Cr alloys decreases at intermediate temperatures around 400° C. While the alloys are not used at temperatures as high as 400° C. in the field of the present invention, and the heat resistance required is around 100° C., or about 200° C. under the most severe conditions required in the present invention, the drawability at intermediate temperatures of around 400° C. is used as a standard of heat resistance. Cu—Cr—Zr alloys have been developed to have improved strength at intermediate temperatures of around 400° C. While Cu—Cr—Zr alloys have excellent fatigue characteristics compared with Cu—Cr alloys, the conductivity of the alloy decreases by increasing the amount of Zr added.

Cu—Cr—Zr alloys are precipitation hardening alloys, and their strength is improved by allowing Cr, Zr or Cu—Zr compounds to precipitate in the copper matrix by aging after solution treatment. However, Cr, Zr or Cr—Zr compounds that are included and which crystallize or precipitate during the casting process remain in the alloy.

Cu—Cr—Zr alloy are usually manufactured by the steps of blending the materials, melting, casting, homogenization annealing, hot rolling, cold rolling if necessary, solution treatment, cold rolling and aging (cold rolling) sequentially applied in this order.

However, the fatigue characteristics are deteriorated in Cu—Cr—Zr alloys since Cu—Zr compounds are readily cleaved by dislocation, and sulfur as one of the inevitable impurities may be concentrated at grain boundaries. The inventors of the present invention found that the grain boundary strength is decreased by concentration of sulfur at the grain boundaries. Accordingly, the object of the present invention is to provide a Cu—Cr—Zr alloy excellent in fatigue and intermediate temperature characteristics.

SUMMARY OF THE INVENTION

Accordingly, it is an object of the present invention to provide a Cu—Cr—Zr alloy excellent in fatigue and intermediate temperature characteristics.

In first and second aspects, the present invention provides a high-strength high-conductivity copper alloy excellent in fatigue and intermediate temperature characteristics comprising 0.05 to 1.0% by mass of Cr and 0.05 to 0.25% by mass of Zr with a balance of Cu and inevitable impurities, and a high strength conductive copper alloy excellent in fatigue and intermediate temperature characteristics comprising 0.05 to 1.0% by mass of Cr, 0.05 to 0.25% by mass of Zr and 0.05 to 2.0% by mass of Zn with a balance of Cu and inevitable impurities, respectively. The alloy comprises inclusion particles based on Zr or a Cu—Zr compound having a diameter of 0.1 $\mu$m or more, and the proportion of the inclusion particles containing 10% or more of sulfur as one of the inevitable impurities is one particles/mm$^2$ or more.

In third and fourth aspects, the present invention provides a high-strength high-conductivity copper alloy excellent in fatigue and intermediate temperature characteristics comprising 0.05 to 1.0% by mass of Cr and 0.05 to 0.25% by mass of Zr with a balance of Cu and inevitable impurities, and a high strength conductive copper alloy excellent in fatigue and intermediate temperature characteristics comprising 0.05 to 1.0% by mass of Cr, 0.05 to 0.25% by mass of Zr and 0.05 to 2.0% by mass of Zn with a balance of Cu and inevitable impurities, respectively. The alloy comprises inclusion particles based on Zr or a Cu—Zr compound having a diameter of 0.1 $\mu$m or more, and the proportion of the inclusion particles containing sulfur as one of the inevitable impurities is 1,000 particles/mm$^2$ or more.

The inevitable impurities as used in the present invention refer to elements having a mean concentration of 100 ppm maximum in the alloy.

The functions of the elements Cr, Zr, Zn, and S are as follows.

Cr and Zr

Cr and Zr serve to improve the strength by being precipitated in the copper matrix by aging after the solution treatment of the alloy. The effect of Cr cannot be achieved when the content of Cr is less than 0.05% by mass, while the strength is not further increased adding Cr in an amount exceeding 1.0% by mass. The effect of Zr cannot be obtained when the content of Zr is less than 0.05% by mass, while the strength is not further increased by adding Zr in an amount exceeding 0.25% by mass.

Zn

Zn is an element added to improve the heat-peeling resistance of tin and solder plating. The effect of Zn to improve the heat-peeling resistance of tin and solder plating cannot be obtained when the content of Zn is less than 0.05% by mass, while conductivity of the alloy decreases when the content of Zn exceeds 2.0% by mass.

Sulfur

While the Cu—Cr—Zr alloy is manufactured by melting cathode copper or oxygen-free copper as a principal material with the addition of Cr and Zr, sulfur is usually contained in a proportion of about 20 ppm as an inevitable impurity. However, sulfur may be concentrated at grain boundaries, and concentration of sulfur at the grain boundaries decreases the grain boundary strength. Although it is possible to decrease sulfur as the inevitable impurity below the level described above, it is not preferable considering the productivity and production cost. The inventors of the present invention found that the sulfur concentration at the grain boundaries could be reduced by allowing the inclusions based on Zr or a Cu—Zr compound to contain a larger amount of sulfur. The grain boundary strength at an intermediate temperature in the range of 250 to 550° C. as well as drawability at an intermediate temperature of around 400° C. can be improved by the effect described above.

Although the Cu—Cr—Zr alloy is excellent in fatigue characteristics, the Cu—Zr compound is readily cleaved by dislocation to soften cleaved sliding faces causing uneven distribution of strain and deterioration of the fatigue characteristics. However, the strength of the Cu—Zr compound itself increases by allowing the compound to contain sulfur to prevent cleavage of the compound by dislocation from occurring while the fatigue characteristics are further improved.

Incidentally, the inclusion particles based on Zr or a Cu—Zr compound is able to contain more sulfur even when a material containing a high concentration of sulfur (for example greased scrap) is used after melting.

Effect of Reducing the Size of the Compound

The size of the compound is preferably fine considering the strength, etching processibility, bending processibility and fatigue characteristics. It was found that large Cu—Zr particles with a diameter of 10 $\mu$m or more could be extinguished under the conditions of the present invention in which Zr or the Cu—Zr compound contains sulfur. Reducing the number of larger particles is particularly effective when large quantities of Cr and Zr are added.

Comparing the results of strength measurement at the intermediate temperature and the sulfur concentration in the inclusions based on Zr or Cu—Zr compound, the inventors of the present invention found (1) a quantitative relationship showing that the strength at the intermediate temperature is excellent when the concentration of the inclusion is 1 particle/mm$^2$ or more while the strength at the intermediate temperature is insufficient when the concentration of the inclusion is 1 particle/mm$^2$ or less, by counting the number of the inclusion particles containing 10% or more of sulfur obtained from the measurement of the sulfur concentration only in the inclusions based on Zr or the Cu—Zr compound having a particle diameter of 0.1 $\mu$m or more, and (2) a quantitative relationship showing that drawability at the intermediate temperature is excellent when the concentration of inclusions is 1000 particles/mm$^2$ or more while drawability at the intermediate temperature is insufficient when the concentration of inclusions is 1000 particles/mm$^2$ or less, by measuring the sulfur concentration in all the inclusions based on the Zr or Cu—Zr compound, and by counting the number of compound particles in which sulfur is detected by field emission-scanning electron microscopy/energy diverse spectroscopy (FE-SEM/EDS), field emission-Auger electron microscope (FE-AES) or transparent electron microscope (TEM).

DESCRIPTION OF THE PREFERRED EMBODIMENTS

Embodiments of the high-strength high-conductivity copper alloy excellent in fatigue and intermediate temperature characteristics according to the present invention will be described in detail hereinafter.

Components were blended in a prescribed proportion using cathode copper or oxygen-free copper as a major material, and the material was cast into an ingot after melting the material in an inert atmosphere or in a vacuum. Then, the ingot was annealed for homogenization at 800 to 1000° C. for 1 hour or more followed by hot rolling and solution treatment. Subsequently, the ingot was annealed after cold rolling followed by cold rolling again and aging to allow strain relaxation.

The order of the manufacturing steps in this embodiment is approximately the same as the order of steps in the conventional manufacturing process. However, the solution treatment condition is determined depending on the result of the sulfur concentration analysis in this embodiment after analyzing the sulfur concentration in the inclusions to adjust the concentration profile. The high-strength high-conductivity copper alloy is obtained by increasing the sulfur concentration of the inclusions by the manufacturing method in this embodiment, in which concentration profiles are adjusted by controlling the solution treatment. Samples in the examples are obtained in this embodiment by applying the solution treatment using a combination of air cooling and water cooling after maintaining the sample at a high temperature of 800° C. or more.

The solution treatment in this embodiment may be applied by controlling the water cooling method during winding of a coil immediately after hot rolling, or the wound coil after hot rolling may be air-cooled or water-cooled after transferring the coil to a heating furnace and leaving there for a given period of time. Hot rolling and solution treatment are applied approximately at the same time in the former case.

EXAMPLES

The sample in Example 1 was prepared by the manufacturing method of this embodiment using an alloy with a composition of Cu—Cr(0.2%)-Zr(0.08%)-Zn(0.15%), and the sample in Comparative Example 1 was prepared according to the conventional method.

The sample in Example 2 was prepared by the manufacturing method of this embodiment using an alloy with a composition of Cu—Cr(0.2%)-Zr(0.04%), and the sample in Comparative Example 2 was prepared according to the conventional method.

The sample in Example 3 was prepared by the manufacturing method of this embodiment using an alloy with a composition of Cu—Cr(0.6%)-Zr(0.15%), and the sample in Comparative Example 3 was prepared according to the conventional method.

The samples in Examples 1 to 3 and Comparative Examples 1 to 3 were electropolished after mechanical polishing, and the texture of the metal was observed by SEM, EDS, FE-SEM, AES, FE-AES and TEM depending on the size of the inclusions contained in each sample to determine the size of the inclusion and the concentration of sulfur in the inclusion. Two hundred or more inclusions having a particle diameter of 0.1 μm or more were randomly selected from an area of 1 mm×1 mm or more, and the sulfur concentration in the selected inclusions was measured. The results of measurements of the sulfur concentration in the inclusions are shown in Table 1.

The numbers of inclusions per 1 $mm^2$ in which sulfur was detected were as high as 1550, 1010 and 2160, respectively, in Examples 1, 2 and 3. On the contrary, the numbers were about a half or less of the numbers above, or 480, 410 and 590, respectively, in Comparative Examples 1, 2 and 3, showing that the alloys contained a few inclusions.

TABLE 1

| | Alloy Composition | The maximum concentration of S contained in the second phase particles with a diameter of 0.1 μm or more | The number of second phase particles (particles/$mm^2$) in which S is detected | The number of inclusions with a diameter of 0.1 μm or more and S content of 10% or more | The number of second phase particles with a diameter of 10 μm or more | Cross-section reduction ratio (400° C.) |
|---|---|---|---|---|---|---|
| Example 1 | Cu-Cr(0.2%)-Zr(0.08%)-Zn(0.15%) | 20.1% | 1550 | 320 | 0 | 67% |
| Comparative Example 1 | Cu-Cr(0.2%)-Zr(0.08%)-Zn(0.15%) | 7.5% | 480 | 0 | 2 | 53% |
| Example 2 | Cu-Cr(0.2%)-Zr(0.04%) | 25.3% | 1010 | 137 | 0 | 60% |
| Comparative Example 2 | Cu-Cr(0.2%)-Zr(0.04%) | 7.3% | 410 | 0 | 3 | 49% |
| Example 3 | Cu-Cr(0.6%)-Zr(0.15%) | 25.6% | 2160 | 530 | 0 | 70% |
| Comparative Example 3 | Cu-Cr(0.6%)-Zr(0.15%) | 6.7% | 590 | 0 | 15 | 55% |

| | Cross-section reduction ratio (500° C.) | Fragility at intermediate temperature | 0.2% proof stress | Electric conductivity | Fatigue characteristics |
|---|---|---|---|---|---|
| Example 1 | 60% | Excellent | 580 MPa | 80% IACS | Excellent |
| Comparative Example 1 | 35% | Poor | 570 MPa | 81% IACS | Poor |
| Example 2 | 54% | Excellent | 520 MPa | 86% IACS | Excellent |
| Comparative Example 2 | 32% | Poor | 505 MPa | 85% IACS | Poor |
| Example 3 | 57% | Excellent | 670 MPa | 68% IACS | Excellent |
| Comparative Example 3 | 33% | Poor | 650 MPa | 70% IACS | Good |

The maximum concentrations of sulfur contained in the inclusions with a diameter of 0.1 μm or more were as high as 20.1%, 25.3% and 25.6%, respectively, in Examples 1, 2 and 3. These results show that the alloy contains at least one inclusion with a diameter of 0.1 μm or more containing at least 10% of sulfur. On the contrary, the maximum concentrations of sulfur contained in all the inclusions with a diameter of 0.1 μm or more were less than 10%, or 7.5%, 7.3% and 6.7%, respectively, in Comparative Examples 1, 2 and 3. This means that the alloy contains no inclusions with a diameter of 0.1 μm or more containing 10% or more of sulfur.

The numbers of inclusions having a diameter of 0.1 μm or more and a sulfur content of 10% or more per 1 $mm^2$ were as high as 320, 137 and 530, respectively, in Examples 1, 2 and 3. On the contrary, the numbers were zero in all the alloys in Comparative Examples 1, 2 and 3, showing that no inclusions with a diameter of 0.1 μm or more were contained in the alloys at all.

It can be statistically concluded that the alloys in the examples of the present invention contain a considerable number of inclusions containing sulfur, and the content exceeds 10% in all the alloys. On the other hand, the contents in all the alloys are less than 10% and the number of inclusions containing sulfur is small in the comparative examples.

Test pieces for tensile strength tests were sampled from the plate samples in Examples 1 to 3 and Comparative Examples 1 to 3, and the tensile strength test at high temperatures was performed at 400° C. and 500° C. The results are also shown in Table 1.

The cross-section reduction ratio Ra is defined by equation 1.

$$Ra(\%)=[(So-Sf)/So]\times 100 \quad (1)$$

So: cross-sectional area of the test piece before the tensile strength test

Sf: cross-sectional area of the test piece after the tensile strength test

The cross-section reduction ratios by the tensile strength test at 400° C. were 67%, 60% and 70%, respectively, in Examples 1, 2 and 3, while the ratios were 53%, 49% and 55%, respectively, in Comparative Examples 1, 2 and 3. These results show that the samples in the examples have larger cross-section reduction ratios than those in the samples in the comparative examples, and the former samples are superior to the latter samples in drawability.

The cross-section reduction ratios in the tensile strength test at 500° C. were 60%, 54% and 57%, respectively, in Examples 1, 2 and 3, while the ratios were 35%, 32% and 33%, respectively, in Comparative Examples 1, 2 and 3. Therefore, the tendency described above becomes more evident at higher temperatures.

Fatigue test pieces were sampled from the plate samples in Examples 1 to 3 and Comparative Examples 1 to 3, and were evaluated by an in-plane bend fatigue test. The fatigue characteristics were tested by controlling the bend stress, and both ends of the plate were displaced relative to a neutral point by applying a stress in both directions relative to the plane of the plate. The samples that broke after $10^7$ repeated deformations, $10^6$ repeated deformations and $10^7$ times or less, and $10^6$ repeated deformations at a stress amplitude of 200 MPa (the maximum stress) were evaluated as excellent. The results of the fatigue characteristics tests are shown in Table 1.

While the samples in Examples 1 to 3 did not break with $10^7$ repeated deformations, the samples in Comparative Examples 1 and 2 broke before $10^5$ repeated deformations, and the sample in Comparative Example 3 broke between $10^6$ to $10^7$ repeated deformations. These results show that the samples in the examples are superior to the samples in the comparative examples in fatigue characteristics.

Tensile strength test pieces were sampled from the plate samples in Examples 1 to 3 and Comparative Examples 1 to 3 for the tensile strength test at room temperature to measure the 0.2% proof stress. The 0.2% proof stress at room temperature is shown in Table 1.

The 0.2% proof stresses at room temperature were 580 MPa, 520 MPa and 670 MPA, respectively, in Examples 1, 2 and 3, while the values were 570 MPa, 505 MPa and 650 MPa, respectively, in Comparative Examples 1, 2 and 3. The 0.2% proof stresses at room temperature in the examples are slightly higher than those in the comparative examples.

Test pieces were sampled from the plate samples in Examples 1 to 3 and Comparative Examples 1 to 3, and their electric conductivity was measured at room temperature by a four-point method. The results of the measurements are shown in Table 1.

The values of the electrical conductivity at room temperature were 80% IACS, 86% IACS and 68% IACS, respectively, in Examples 1, 2 and 3, while the values were 81% IACS, 85% IACS and 70% IACS, respectively, in Comparative Examples 1, 2 and 3. These values are almost the same as each other.

The high-strength high-conductivity copper alloy according to the present invention is excellent in fatigue characteristics as well as in drawability at an intermediate temperature of around 400° C. while the alloy maintains good conductivity. Assembling of electronic components at a relatively high temperature can be facilitated by using the high-strength high-conductivity copper alloy according to the present invention as a material for the electronic components to enable the characteristics of the electronic components at a relatively high temperature to be improved while also facilitating the compactness of electronic appliances.

What is claimed is:

1. A high-strength high-conductive copper alloy excellent in fatigue and intermediate temperature characteristics comprising 0.05 to 1.0% by mass of Cr and 0.05 to 0.25% by mass of Zr with a balance of Cu and inevitable impurities, the alloy comprising inclusion particles based on any one of Zr and a Cu—Zr alloy having a diameter of 0.1 $\mu$m or more, the proportion of the inclusion particles containing 10% or more of sulfur as one of the inevitable impurities being one particles/mm$^2$.

2. A high-strength high-conductive copper alloy excellent in fatigue and intermediate temperature characteristics comprising 0.05 to 1.0% by mass of Cr, 0.05 to 0.25% by mass of Zr and 0.05 to 2.0% by mass of Zn with a balance of Cu and inevitable impurities, the alloy comprising inclusion particles based on any one of Zr and a Cu—Zr alloy having a diameter of 0.1 $\mu$m or more, the proportion of the inclusion particles containing 10% or more of sulfur as one of the inevitable impurities being one particles/mm$^2$.

3. A high-strength high-conductive copper alloy excellent in fatigue and intermediate temperature characteristics comprising 0.05 to 1.0% by mass of Cr and 0.05 to 0.25% by mass of Zr with a balance of Cu and inevitable impurities, the alloy comprising inclusion particles based on any one of Zr and a Cu—Zr alloy having a diameter of 0.1 $\mu$m or more, the proportion of the inclusion particles containing sulfur as one of the inevitable impurities being 1,000 particles/mm$^2$.

4. A high-strength high-conductive copper alloy excellent in fatigue and intermediate temperature characteristics comprising 0.05 to 1.0% by mass of Cr, 0.05 to 0.25% by mass of Zr and 0.05 to 2.0% by mass of Zn with a balance of Cu and inevitable impurities, the alloy comprising inclusion particles based on any one of Zr and a Cu—Zr alloy having a diameter of 0.1 $\mu$m or more, the proportion of the inclusion particles containing sulfur as one of the inevitable impurities being 1,000 particles/mm$^2$.

* * * * *